US006709238B2

(12) United States Patent
Marshall

(10) Patent No.: US 6,709,238 B2
(45) Date of Patent: Mar. 23, 2004

(54) TWO-PIECE SAFETY MECHANISM FOR CEILING FANS

(76) Inventor: John C. Marshall, 6249 Thibodeaux Rd., Greenwell Springs, LA (US) 70739

( * ) Notice: Subject to any disclaimer, the term of this patent is extended or adjusted under 35 U.S.C. 154(b) by 89 days.

(21) Appl. No.: 10/187,832

(22) Filed: Jul. 3, 2002

(65) Prior Publication Data

US 2004/0005218 A1 Jan. 8, 2004

(51) Int. Cl.[7] ..... F01D 25/00
(52) U.S. Cl. ..... 416/210 R; 403/291
(58) Field of Search ..... 416/146, 2, 5, 416/134 R, 210 R, 194; 248/343, 328, 339; 403/291, 220, 221, 223

(56) References Cited

U.S. PATENT DOCUMENTS

| | | | | |
|---|---|---|---|---|
| 1,293,381 A | | 2/1919 | Dupuy | |
| 5,246,303 A | * | 9/1993 | Trilla et al. | 403/353 |
| 5,442,132 A | | 8/1995 | Sandell et al. | |
| 5,542,819 A | | 8/1996 | Bucher et al. | |
| 5,560,101 A | | 10/1996 | Sandell et al. | |
| 6,145,798 A | | 11/2000 | Janisse et al. | |

FOREIGN PATENT DOCUMENTS

| | | |
|---|---|---|
| JP | 362243990 A | 10/1987 |
| JP | 405157092 | 6/1993 |
| JP | 406088596 A | 3/1994 |

* cited by examiner

*Primary Examiner*—Edward K. Look
*Assistant Examiner*—Kimya N McCoy
(74) *Attorney, Agent, or Firm*—Liniak, Berenato & White, LLC

(57) ABSTRACT

A two-piece safety mechanism for ceiling-mounted fans comprises a first and second cable. The first cable has a first fastener extending from a first end and a first connector extending from a second end. The first fastener is for operable association with a first fastening mechanism for securing the first cable to a fan. The second cable has a second fastener extending from a first end. The second fastener is for operable association with a second fastening mechanism for securing the second cable to a ceiling support. The second cable also has a second connector extending from a second end, which is releaseably attachable to the first connector to form a continuous cable. The claimed invention also provides for a ceiling fan having the two-piece safety mechanism for retaining the fan in close proximity to the ceiling support if its normal mounting apparatus should fail.

52 Claims, 3 Drawing Sheets

TWO-PIECE SAFETY MECHANISM FOR CEILING FANS

BACKGROUND OF THE INVENTION

1. Field of the Invention

The present invention relates to a two-piece safety mechanism for use with ceiling fans. A first cable attaches to a ceiling fan, and a second cable attaches to a ceiling support. The first and second cables have first and second connectors, respectively, which releaseably attach to form a continuous cable that retains the ceiling fan in close proximity to a ceiling support if the fan's normal mounting apparatus should fail.

2. Description of the Prior Art

A conventional ceiling fan consists of a motor suspended from a ceiling with radially extending fan blades operably associated with the motor. A cylindrical body, or downrod, is secured to the motor on one end. On the opposing end, the downrod includes a hanger ball. The hanger ball is generally secured to a mounting bracket, and the mounting bracket is secured to a support from a ceiling support. Therefore, the downrod, hanger ball, and mounting bracket work in conjunction to hang the fan from the ceiling support. Electrical wiring from the fan is generally attached to an electrical box in the ceiling. It is known in the art that such ceiling mounted fans may be subject to falling for various reasons.

A ceiling fan may fall if it is installed improperly. The mounting bracket must be properly secured to the ceiling support. Furthermore, the support must be capable of holding the fan. If not, the fan may fall, damaging the fan or other property, or even causing personal injury. Even if the ceiling support can hold the weight of the fan, the mounting bracket may fail.

In addition, many fans are manufactured with metric bolts, screws or corresponding threads. However, some electrical boxes, especially those manufactured in the United States, have standard threads. When a metric component is fastened to a standard component, a proper fit is not achieved and the attachment may pull free.

Ceiling fans may also fall if faulty or defective materials are used in the fan components. Many mounting brackets manufactured today are largely composed of zinc. When casting zinc brackets, the zinc must not contain impurities. Impurities in a cast zinc mounting bracket may cause brittleness over time and break. Although zinc brackets today may be cast properly, faulty mounting brackets are always a possibility so long as zinc is used in their manufacture.

In addition, ceiling fans are sometimes unbalanced. An unbalanced fan continuously rocks back and forth. The constant, repetitive rocking motion can loosen electrical or mounting connections, cause metal fatigue, and ultimately cause the fan to fall.

To curb the installation of faulty ceiling fans that are prone to falling, and the installation of poorly secured electrical boxes, the National Electrical Code (NEC) Organization has approved only certain fan and electrical box designs, and mandated that only the approved designs be used on new fan installations. Although this mandate is helpful, it does not entirely prevent the above noted problems. Therefore, there is a need for safety mechanisms that will prevent the fan from falling, and potentially causing personal or property damage.

Various designs in the prior art attempt to solve the above noted problems with ceiling fans, and thereby reduce the possibility that the fan will fall. Some designs require that the mounting bracket be attached to the ceiling support using additional bolts or screws. However, such designs do not allow for easy installation or removal, given additional fasteners must be secured to the ceiling support. Likewise, removal of the fan after it is initially secured is difficult, requiring the removal of the additional fasteners.

Other designs include a single safety cable, which is connected to the fan by one end and to the ceiling support by the opposing end. This design may prevent the fan from falling if the fan mounting should fail, but complicates installation. In order to properly secure a single safety cable to the ceiling support, the fan and mounting bracket must be out of the way. The single cable must first be attached to the fan, and then attached to the ceiling support before the mounting bracket has been secured to the ceiling support (if the mounting bracket is attached beforehand, the single cable may not be properly secured). In the alternative, the single cable could first be attached to the ceiling support. However, the same problems arise. Specifically, the fan would first need to be attached to the mounting bracket, and then the single cable attached to the fan. Thereafter, the fan and mounting bracket would be secured to the ceiling support. Installation of the single safety cable mechanism is therefore inconvenient and difficult.

In addition, many conventional fan designs require partial un-assembly when attaching such a single safety cable mechanism. Thus, installation is further complicated given such un-assembly and subsequent re-assembly would be required when hanging the fan, instead of when the fan is on the floor. Therefore, the single safety cable is not a practical solution. Subsequent removal of the fan, for cleaning, maintenance, replacement, etc., is also complicated when using a single safety cable for similar reasons.

As such, a safety cable mechanism is needed which prevents a ceiling fan from falling, while maintaining simple and efficient installation and subsequent removal procedures. The present invention provides for a two-piece safety mechanism for ceiling mounted fans, which is easy to install and prevents the fan from falling more than a few inches should its normal mounting apparatus fail.

SUMMARY OF THE INVENTION

A two-piece safety mechanism for ceiling-mounted fans comprises first and second cables. The first cable has a first fastener extending from a first end and a first connector extending from a second end. The first fastener is for operable association with a first fastening mechanism for securing the first cable to a fae. The second cable has a second fastener extending from a first end. The second fastener is for operable association with a second fastening mechanism for securing the second cable to a ceiling support. The second cable also has a second connector extending from a second end. The second connector is releaseably attachable to the first connector, so that the first and second cables may form a continuous cable.

The present invention also relates to a ceiling fan including a two-piece safety mechanism. The ceiling fan with a two-piece safety mechanism comprises a mounting bracket for securing to a ceiling support, a ceiling fan for securing to the mounting bracket, and the two-piece safety mechanism described above. The ceiling fan comprises a motor, a motor housing having a plurality of radially extending fan blades operably associated with the motor, a downrod having a hanger ball for hanging the ceiling fan from the mounting bracket, and electrical wires associated with the motor. The first fastener of the first cable is secured to the fan, and the second fastener from the second cable is secured to the ceiling support. The first and second connectors from the first and second cables may be releaseably attached to form a continuous cable. The continuous cable retains the fan in close proximity to the ceiling support if the mounting bracket fails.

A method of securing a ceiling fan to a ceiling support comprises the following steps: securing a first end of a first cable to a ceiling fan; securing a first end of a second cable to a ceiling support; securing a mounting bracket to the ceiling support; hanging the ceiling fan from the mounting bracket; and connecting a second end of the first cable to a second end of the second cable so that the first and second cables attach to form a continuous cable.

The claimed invention also provides for a mounted ceiling fan comprising a mounting bracket secured to a ceiling support, a downrod having a hanger ball secured to the mounting bracket, a fan secured to the downrod, a first cable secured to the downrod, and a second cable secured to the ceiling support. The first and second cables further include first and second connectors, respectively, which are releaseably attached forming a continuous cable for retaining the fan in close proximity to the ceiling support should the mounting bracket fail.

In a second embodiment of the present invention, a safety mechanism for ceiling-mounted fans is provided, comprising a cable having a fastener extending from a first end and a connector extending from a second end. The fastener is for operable association with a first fastening mechanism for securing the cable to a fan. A shaped body, preferably L-shaped, is also provided, having a first end and a second end. The first end has a first opening for operable association with a second fastening mechanism for securing the shaped body to a ceiling support. The second end of the shaped body has a second opening configured for receiving the connector for releasably securing the connector therein.

DETAILED DESCRIPTION OF THE INVENTION

Figure 1:
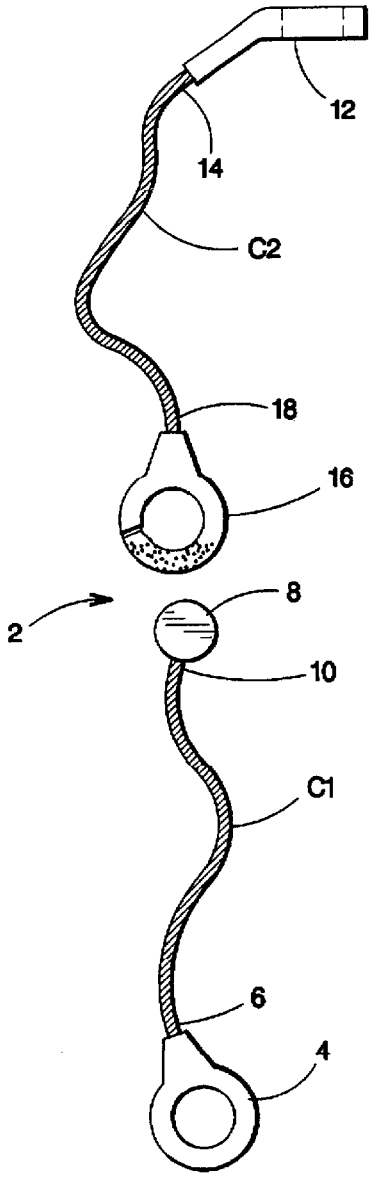
FIG. 1 is an elevational view of a two-piece safety mechanism according to the present invention.
Figure 2:
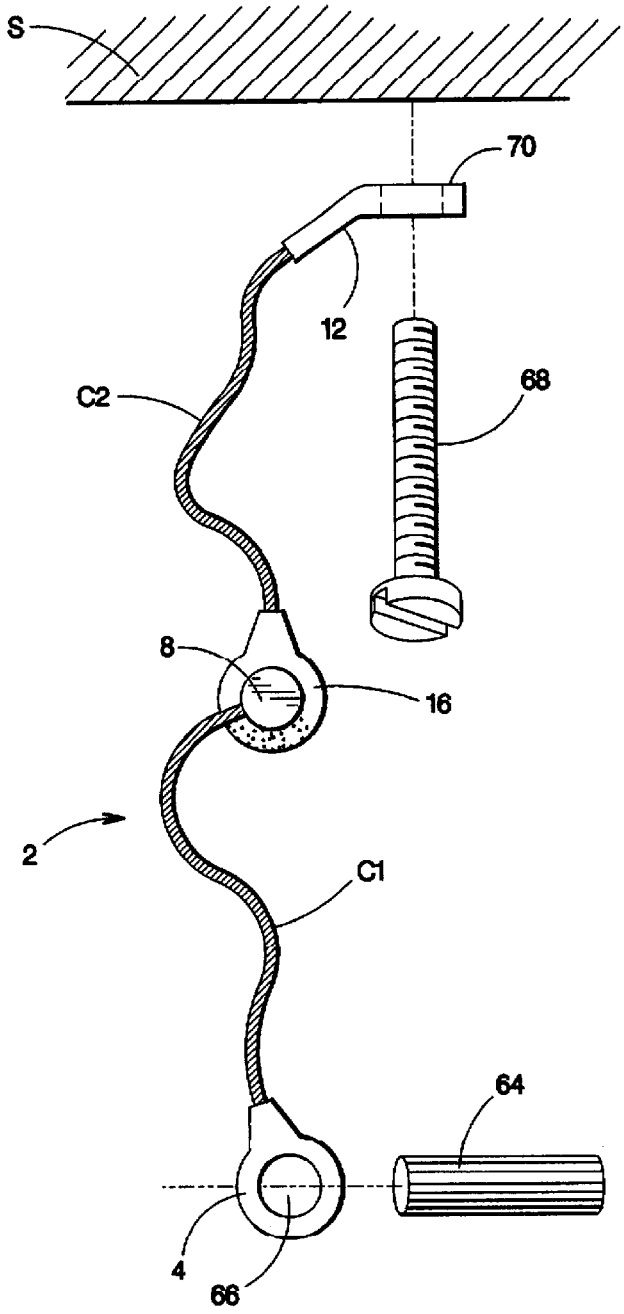
FIG. 2 is an elevational view of a continuous cable according to the present invention.

As best shown in FIG. 1, a two-piece safety mechanism 2 for a ceiling mounted fan comprises a first cable C1 and a second cable C2. First cable C1 has a first fastener 4 extending from a first end 6, and a first connector 8 extending from a second end 10. Second cable C2 has a second fastener 12 extending from a first end 14, and a second connector 16 extending from a second end 18. Second connector 16 is operably associated with first connector 8 for releaseably attaching first cable C1 and second cable C2 to form a continuous cable, as best shown in FIG. 2. The continuous cable may be easily detached, reforming first cable C1 and second cable C2 by simply disconnecting first connector 8 from second connector 16.

Figure 3:
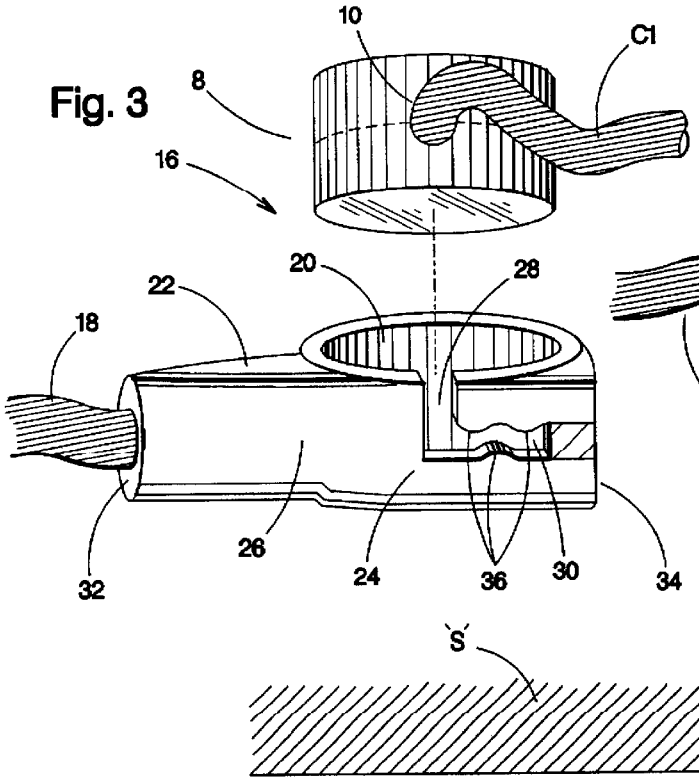
FIG. 3 is a fragmentary exploded assembly view of a second connector according to the present invention.

As best shown in FIG. 3, second connector 16 is an elongate body having an opening 20, which is configured to receive first connector 8. Second connector 16 has opposed first and second major surfaces 22 and 24, respectively. Opening 20 extends through major surfaces 22 and 24. A side 26 extends between major surface 22 and major surface 24. First and second slots 28 and 30, respectively, extend through side 26 and into opening 20, and cooperate with cylindrical opening 20 for receiving first connector 8 and second end 10 of first cable C1.

Side 26 of second connector 16 has a first end 32 and a second end 34, as best shown in FIG. 3. Second cable C2 extends from second connector 16 proximate first end 32. Opening 20 is proximate opposing second end 34. First slot 28 extends from first major surface 22 through side 26 to a point intermediate to second major surface 24. This intermediate point preferably is equidistant from major surfaces 22 and 24. Second slot 30 extends through side 26 to opening 20 intermediate major surfaces 22 and 24, extending from the intermediate point of first slot 28 to second end 34 of side 26. Second slot 30 preferably is perpendicular to first slot 28. Second slot 30 preferably is parallel to major surfaces 22 and 24. In addition, second slot 30 may have ridges 36 for securing first cable C1 and first connector 8.

Figure 4:
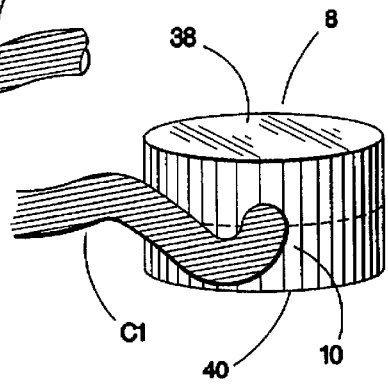
FIG. 4 is a fragmentary exploded prospective view of a first connector according to the present invention.

As best shown in FIG. 4, first connector 8 preferably is cylindrical, with flat surfaces 38 and 40. First connector 8 is sized to be received in opening 20 of second connector 16. First connector 8 is received in opening 20 so that second end 10 of first cable C1 may be aligned with first slot 28, as best shown in FIG. 3. First connector 8 is inserted into opening 20. Second end 10 of first cable C1 is aligned with, and inserted into, slot 28. Flat surfaces 38 and 40 may be flush with major surfaces 22 and 24 after insertion of first connector 8 into opening 20. First connector 8, along with second end 10 of first cable C1, is moved into second slot 30 by swiveling first connector 8 within opening 20. Second end 10 of first cable C1 thereafter moves into second slot 30 and past ridges 36, so that first cable C1 extends from slot 30 proximate second end 34 of second connector 16. First and second slots 28 and 30, along with ridges 36 cooperate to releaseably attach first and second cables C1 and C2, thereby forming a continuous cable. The first and second connectors may be made of zinc, or other suitable materials.

Figure 5:
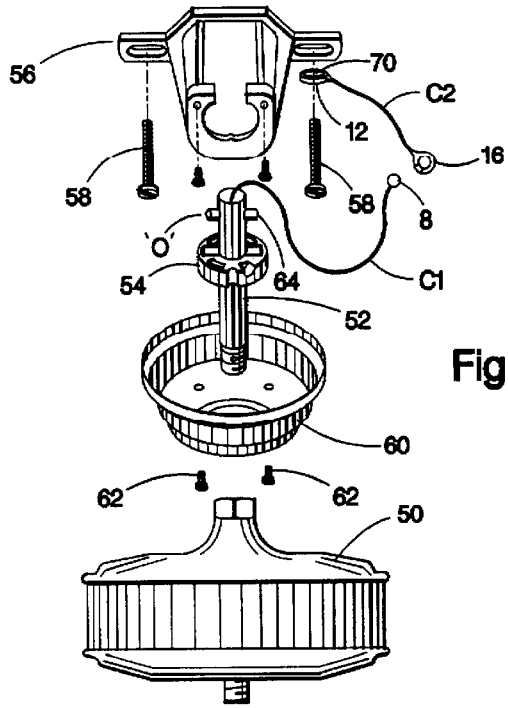
FIG. 5 is an assembly view of a ceiling fan with the two-piece safety mechanism and a second installation method for the present invention.

In a preferred embodiment of the present invention, two-piece safety mechanism 2 is operably associated with a ceiling fan. Mounting components for a ceiling fan with safety mechanism 2 are best shown in FIG. 5. Generally, a ceiling fan includes a fan motor 50, which is attached to a downrod 52. Downrod 52 includes a hanger ball 54, which is operably associated with a mounting bracket 56 for hanging the ceiling fan from ceiling support S. Hanger ball 54 fits into a corresponding portion B of mounting bracket 56. Mounting bracket 56 is secured to ceiling support S with a plurality of mounting screws 58. A canopy 60 may cover hanger ball 54 and mounting bracket 56 for aesthetic purposes, and is secured to mounting bracket 56 using canopy screws 62. These components of the ceiling fan are well known in the art.

First cable C1 may be secured to downrod 52 above hanger ball 54, as shown in FIG. 5. Downrod 52 includes a corresponding opening O in which first fastener 4 may be secured using first fastening mechanism 64. First fastener 4 includes an opening 66 through which first fastening mechanism 64 passes, as best shown in FIG. 2. First fastening mechanism 64 may then be secured in corresponding opening O of downrod 52, thereby securing first cable C1, as shown in FIG. 5. In the preferred embodiment, first fastening mechanism 64 is a pin. However, any known fastening mechanism may be used, such as a bolt or a screw. First cable C1 is preferably secured to the ceiling fan before the fan is being secured to mounting bracket 56.

As best shown in FIG. 2, second cable C2 may be secured to the ceiling support S, before mounting bracket 56 is secured to the ceiling support S. Second fastener 12 is secured to ceiling support S using a second fastening mechanism 68. Second fastening mechanism 68 may also include any known fastening mechanism, but is preferably a screw or bolt. Second fastener 12 also includes an opening 70, operably associated with second fastening mechanism 68.

It should be understood, however, that first cable C1 may be also be secured to the ceiling support S. First fastener 4 may be secured to ceiling support S using second fastening mechanism 68. Likewise, second fastener 12 of second cable C2 may be secured in opening O of downrod 52 using first fastening mechanism 64. In this way, first cable C1 and second cable C2 are interchangeable.

In a preferred installation of a ceiling fan having two-piece safety mechanism 2, second fastener 12 is secured directly to ceiling support S using second fastening mechanism 68, as best shown in FIG. 2. Then, mounting bracket 56 may be secured to ceiling support S proximate secured second fastener 12 using mounting screws 58. Having already secured first fastener 4 to the ceiling fan as explained above, the ceiling fan may then be secured to mounting bracket 56 with corresponding hanger ball 54 on downrod 52. First connector 8 may then be releaseably secured to second connector 16, as explained above, along with the associated electrical wiring for the ceiling fan.

First connector 8 and second connector 16 may be easily joined together to form a continuous cable. The continuous cable retains the fan in close proximity to ceiling support S if mounting bracket 56 should fail. First connector 8 and second connector 16 fit securely together, with ridges 36 securing first end 6 of first cable C1 within second slot 30, so that vibrations from operation of a fixture do not cause first and second connectors 8 and 16 to detach.

A second installation for the claimed invention is best shown in FIG. 5, which depicts various mounting components for a ceiling fan, described above. Hanger ball 54 is operably associated with mounting bracket 56, so that hanger ball 54 fits in corresponding portion B of mounting bracket 56. Mounting bracket 56 is first secured to ceiling support S using mounting screws 58. One of the plurality of mounting screws 58 is used to secure second fastener 12. As best shown in FIG. 5, one of the mounting screws 58 is passed through opening 70 of second fastener 12, through the respective area in mounting bracket 56, and into ceiling support S. Thus, one of the mounting screws 58 functions as second fastening mechanism 68. First fastener 4 of cable C1 is secured to the ceiling fan as explained above.

Figure 6:
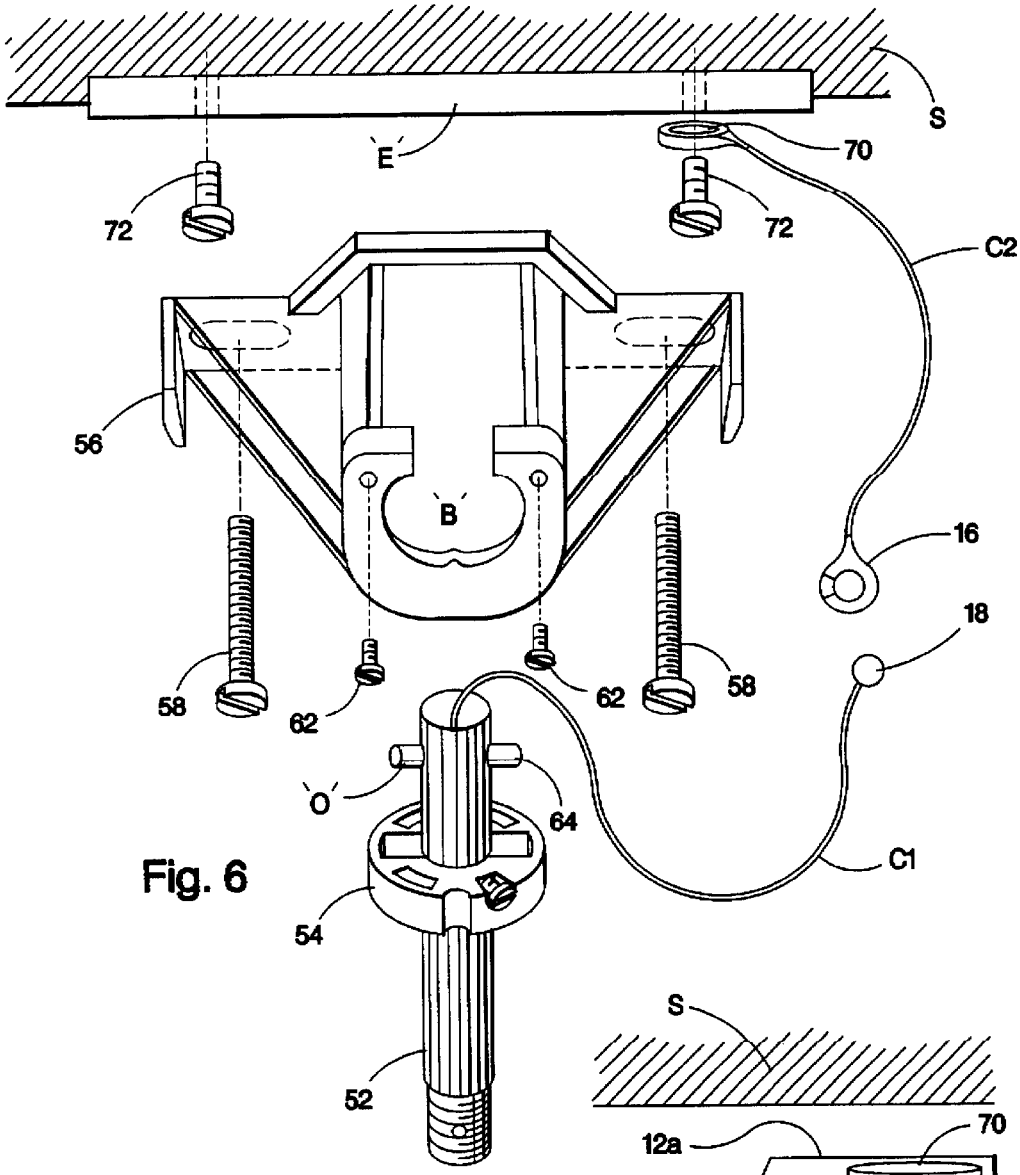
FIG. 6 is an exploded assembly view of a ceiling fan with the two-piece safety mechanism and a third installation method for the present invention.

A third method of installation of the claimed invention is best shown in FIG. 6. Again, first fastener 4 of cable C1 is secured to the ceiling fan as explained above. However, second cable C2 is secured to an electrical box E prior to securing mounting bracket 56 to ceiling support S, as shown in FIG. 6. Generally, electrical box E is secured to ceiling support S by a plurality of electrical box fasteners 72, such as screws or bolts. One of the electrical box fasteners 72 may be used as second fastening mechanism 68, as shown in FIG. 6, wherein second fastener 12 is secured to electrical box E using one of electrical box fasteners 72, which in turn is fastened into ceiling support S. This method of installation may be desirable when an NEC approved electrical box is mounted in ceiling support S.

The two-piece safety mechanism of the present invention makes installation on ceiling fans very simple. First cable C1 is attached to the ceiling fan when it is being assembled on the floor. Second cable C2 is attached to the ceiling support (or electrical box) before the fan is hung from mounting bracket 56. After installing the fan, cables C1 and C2 may be easily joined together using the specially designed first and second connectors, 8 and 16. In addition, if the fan ever requires servicing, cleaning, replacing fan parts, etc., cables C1 and C2 may be easily detached. The two cables are simply disconnected after other disconnections have been made.

Figure 7:
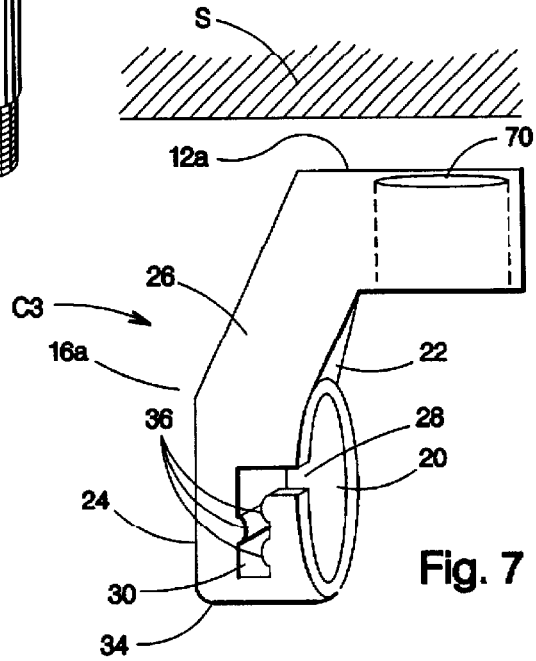
FIG. 7 is an exploded view of an L-shaped body according to a second embodiment of the present invention.

A second embodiment of the invention is best shown in FIG. 7, wherein second cable C2 has been modified, and the intermediate cable between second fastener 12 and second connector 16 has been eliminated. As shown in FIG. 7, second fastener 12*a* and second connector 16*a* are molded as a single shaped body C3, preferably L-shaped, though shaped body C3 need not be at a right angle. Shaped body C3 includes elements corresponding to second fastener 12 and second connector 16, which have been explained above, and correspondingly numbered. Second fastener 12*a* includes an opening 70, which is operably associated with second fastening mechanism 68. Shaped body C3 is secured to ceiling support S using second fastening mechanism 68, as explained above. Second connector 16*a* is operably associated with first connector 8 as explained above, and includes all corresponding elements, as shown in FIG. 7. Shaped body C3 therefore has corresponding openings 70 and 20, which are preferably perpendicular to each other. Slots 28 and 30 are operably associated with opening 20, and slot 30 is preferably parallel with opening 20, and contains ridges 36 as described above. However, it should be understood that shaped body C3 may also be secured in opening O of downrod 52 using first fastening mechanism 64.

It will be apparent to one of ordinary skill in the art that various modifications and variations can be made in construction or configuration of the present invention without departing from the scope or spirit of the invention. Thus, it is intended that the present invention cover the modifications and variations of the invention, provided they come within the scope of the following claims and their equivalents.

What is claimed is:

1. A two-piece safety mechanism for ceiling-mounted fans, comprising:

a first cable having a first fastener extending from a first end and a first connector extending from a second end, said first fastener for operable association with a first fastening mechanism for securing said first cable to a fan; and a second cable having a second fastener extending from a first end, said second fastener for operable association with a second fastening mechanism for securing said second cable to a ceiling support, and said second cable having a second connector extending from a second end, said second connector releaseably attachable to said first connector to form a continuous cable.

2. The mechanism of claim 1, wherein said second connector comprises an elongate body having an opening configured for receiving said first connector.

3. The mechanism of claim 2, wherein said elongate body has opposed first and second major surfaces, and said opening extends through said major surfaces.

4. The mechanism of claim 3, wherein a side extends between said major surfaces, and said side has first and second cooperating slots extending into said opening and operably associated with said opening for receiving said first cable.

5. The mechanism of claim 4, wherein said side includes a first end and a second end, said second cable extending from said first end and said slots are proximate said second end.

6. The mechanism of claim 5, wherein said first slot extends from said opening on said first major surface through said side to a point intermediate to said second major surface.

7. The mechanism of claim 6, wherein said first slot extends through said side to a position that is equidistant from said major surfaces.

8. The mechanism of claim 6, wherein said second slot extends to a second point proximate said second end.

9. The mechanism of claim 8, wherein said second slot is perpendicular to said first slot.

10. The mechanism of claim 8, wherein said second slot is parallel to one of said major surfaces.

11. The mechanism of claim 4, wherein ridges are disposed within said second slot for securing said first cable.

12. The mechanism of claim 11, wherein said elongate body consists of zinc.

13. The mechanism of claim 4, wherein said first connector is cylindrical and sized to be received in said opening.

14. The mechanism of claim 13, wherein ridges are disposed within said second slot for securing said first cable.

15. The mechanism of claim 14, wherein said first connector consists of zinc.

16. The mechanism of claim 1, wherein said first fastener comprises an elongate body having an opening for operable association with the first fastening mechanism.

17. The mechanism of claim 16, wherein said first cable extends from a first end of said elongate body, and said opening is proximate a second end of said elongate body.

18. The mechanism of claim 1, wherein said second fastener comprises an elongate body having an opening for operable association with the second fastening mechanism.

19. The mechanism of claim 18, wherein said second cable extends from a first end of said elongate body, and said opening is proximate a second end of said elongate body.

20. A ceiling fan with a two-piece safety mechanism, comprising:

a mounting bracket for being secured to a ceiling support;

a ceiling fan for being secured to said mounting bracket, said ceiling fan comprising a motor, a motor housing having a plurality of radially extending fan blades operably associated with the motor, a downrod having a hanger ball for hanging said ceiling fan, and electrical wires associated with the motor;

a first cable having a first fastener extending from a first end and a first connector extending from a second end, said first fastener operably associated with a first fastening mechanism for securing said first cable to said fan; and a second cable having a second fastener extending from a first end, said second fastener operably associated with a second fastening mechanism for securing said second cable to the ceiling support, and said second cable having a second connector extending from a second end, said second connector releaseably attachable to said first connector to form a continuous cable for retaining said fan in close proximity to the ceiling support if said mounting bracket fails.

21. The ceiling fan of claim 20, wherein said second connector comprises an elongate body having an opening configured for receiving said first connector.

22. The ceiling fan of claim 21, wherein said elongate body has opposing first and second major surfaces, and said opening extends through said major surfaces.

23. The ceiling fan of claim 22, wherein a side extends between said major surfaces, and said side has first and second cooperating slots extending into said opening and operably associated with said opening for receiving said first cable.

24. The ceiling fan of claim 23, wherein said side includes a first end and a second end, said second cable extending from said first end and said slots are proximate said second end.

25. The ceiling fan of claim 24, wherein said first slot extends from said opening on said first major surface through said side to a point intermediate to said second major surface.

26. The ceiling fan of claim 25, wherein said first slot extends through said side to a position that is equidistant from said major surfaces.

27. The ceiling fan of claim 26, wherein said second slot extends to a second point proximate said second end.

28. The ceiling fan of claim 27, wherein said second slot is perpendicular to said first slot.

29. The ceiling fan of claim 27, wherein said second slot is parallel to one of said major surfaces.

30. The ceiling fan of claim 23, wherein ridges are disposed within said second slot for securing said first cable so that vibrations from operation of said fan will not detach said first and second connectors.

31. The ceiling fan of claim 30, wherein said elongate body consists of zinc.

32. The ceiling fan of claim 23, wherein said first connector is cylindrical and sized to be received in said opening.

33. The ceiling fan of claim 32, wherein ridges are disposed within said second slot for securing said first cable.

34. The ceiling fan of claim 33, wherein said first connector consists of zinc.

35. The ceiling fan of claim 20, wherein said first fastener comprises an elongate body having an opening operably associated with said first fastening mechanism.

36. The ceiling fan of claim 35, wherein said first fastening mechanism is selected from the group consisting of screws, bolts, and pins.

37. The ceiling fan of claim 20, wherein said second fastener comprises an elongate body having an opening operably associated with said second fastening mechanism.

38. The ceiling fan of claim 37, wherein said second fastening mechanism is selected from the group consisting of screws, bolts, and pins.

39. The ceiling fan of claim 38, wherein said second fastener is secured to said mounting bracket by one of a plurality of mounting fasteners, said mounting fasteners operably associated with said mounting bracket for securing said mounting bracket to the ceiling support.

40. The ceiling fan of claim 38, wherein said second fastener is secured to an electrical box by one of a plurality of electrical box screws, said electrical box screws operably associated with said electrical box for securing said electrical box to the ceiling support.

41. A method of securing a ceiling fan to a ceiling support, comprising the steps of:

securing a first end of a first cable to a ceiling fan;

securing a first end of a second cable to a ceiling support;

securing a mounting bracket to the ceiling support;

hanging the ceiling fan from the mounting bracket; and connecting a second end of the first cable to a second end of the second cable so that the first and second cables form a continuous cable.

42. The method of claim 41, including the steps of:

providing a first cable having a first fastener extending from the first end and a first connector extending from the second end;

providing a second cable having a second fastener extending from the first end and a second connector extending from the second end, wherein the first connector is releaseably attachable to the second connector; and attaching the first and the second connectors to form the continuous cable.

43. The method of claim 42, including the steps of:

securing an electrical box to the ceiling support with a plurality of fasteners; and securing the second fastener to the electrical box using one of the plurality of fasteners.

44. The method of claim 42, including the further steps of:

securing the mounting bracket to the ceiling support with a plurality of fasteners; and securing the second fastener to the ceiling support using one of the plurality of fasteners, wherein one of the plurality of fasteners passes through a corresponding portion of the mounting bracket and into the ceiling support.

45. A ceiling fan with a two-piece safety mechanism, comprising:

a mounting bracket secured to a ceiling support;

a downrod having a hanger ball secured to said mounting bracket, said hanger ball in operable association with said mounting bracket;

a fan secured to said downrod on an end opposing said hanger ball;

a first cable having a first fastener extending from a first end and a first connector extending from a second end, said first fastener secured to said downrod with a first fastening mechanism; and a second cable having a second fastener extending from a first end, said second fastener secured to the ceiling support with a second fastening mechanism, and said second cable having a second connector extending from a second end, said second connector releaseably attached to said first connector forming a continuous cable for retaining said fan in close proximity to the ceiling support if said mounting bracket fails.

46. The ceiling fan of claim 45, wherein said second connector comprises an elongate body having an opening and first and second cooperating slots extending into said opening, said opening and said slots configured for releaseably securing said first connector.

47. The ceiling fan of claim 46, wherein said first connector is cylindrical and sized to be received in said opening.

48. A safety mechanism for ceiling-mounted fans, comprising:

a cable having a fastener extending from a first end and a connector extending from a second end, said fastener for operable association with a first fastening mechanism for securing said cable to one of a fan and a ceiling support; and a shaped body having a first end and a second end, said first end having a first opening for operable association with a second fastening mechanism for securing said shaped body to the other one of the fan and the ceiling support, and said second end having a second opening configured for receiving said connector for releasably securing said connector therein.

49. The mechanism of claim 48, wherein said shaped body has first and second cooperating slots proximate said second end and operably associated with said second opening for receiving said cable.

50. The mechanism of claim 49, wherein said second slot is parallel to said second opening.

51. The mechanism of claim 50, wherein ridges are disposed within said second slot for securing said cable.

52. The mechanism of claim 48, wherein said first opening is perpendicular to said second opening.

* * * * *